United States Patent [19]

Bruggisser et al.

[11] 3,970,260

[45] July 20, 1976

[54] APPARATUS FOR BUILDING A ROTATIONALLY SYMMETRICALLY EVENED BOBBIN PACKAGE AND METHOD OF OPERATING THE APPARATUS

[75] Inventors: Klaus Bruggisser; Felix Graf; Gerhard Mandl, all of Winterthur; Albert Rüegg, Pfaffikon, all of Switzerland

[73] Assignee: Rieter Machine Works, Ltd., Winterthur, Switzerland

[22] Filed: Sept. 16, 1974

[21] Appl. No.: 506,092

[30] Foreign Application Priority Data

Sept. 26, 1973 Switzerland ..... 13798/73

[52] U.S. Cl. ..... 242/18 DD; 74/573 R

[51] Int. Cl.² ..... B65H 54/42

[58] Field of Search ..... 242/18 DD, 18 R, 46.2, 242/43.3, 46.4, 46.5, 46.6; 73/468, 470; 74/573

[56] References Cited

UNITED STATES PATENTS

| | | | |
|---|---|---|---|
| 414,642 | 11/1889 | Herrick | 74/573 |
| 1,209,730 | 12/1916 | Leblanc | 74/573 |
| 1,967,163 | 7/1934 | Thearle | 73/470 X |
| 2,778,243 | 1/1957 | Darrieus | 74/573 |
| 3,164,413 | 1/1965 | Salathiel | 74/573 X |
| 3,282,127 | 11/1966 | Deakin | 74/573 |
| 3,346,303 | 10/1967 | Wesley | 74/573 X |
| 3,355,116 | 11/1967 | Conrad | 242/18 DD |
| 3,696,688 | 10/1972 | Goodrich et al. | 74/573 |
| 3,733,923 | 5/1973 | Goodrich et al. | 74/573 |
| 3,807,647 | 4/1974 | Miller | 242/18 DD |

*Primary Examiner*—Stanley N. Gilreath
*Attorney, Agent, or Firm*—Werner W. Kleeman

[57] ABSTRACT

Apparatus for building a rotationally symmetrically evened bobbin package with a bobbin chuck for supporting the bobbin and with a friction drive drum for driving the bobbin. The bobbin chuck is rotatable at speeds above the critical rotational speed and there is provided on the bobbin chuck a balancing element with a mass which is freely movable along a circular path concentric with the bobbin chuck axis, which mass in the centered position of the bobbin chuck is distributable evenly and automatically along the path.

17 Claims, 14 Drawing Figures

Fig. 8
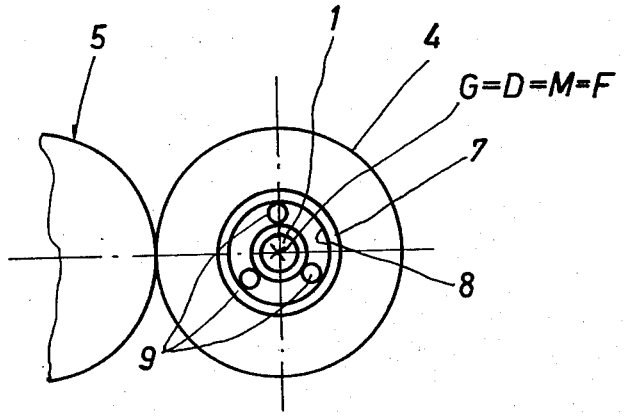
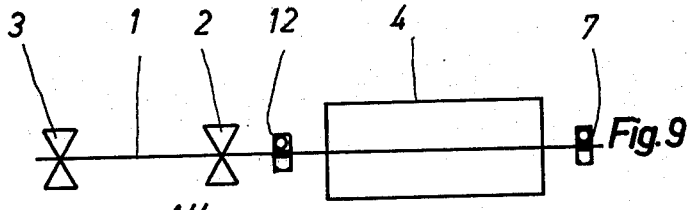
Fig. 9
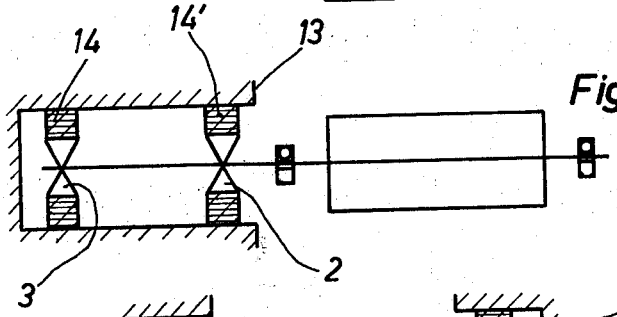
Fig. 1o
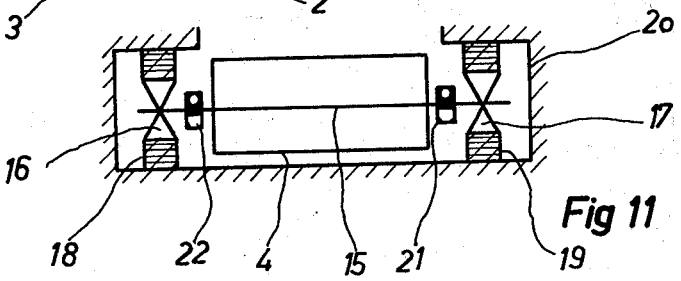
Fig 11

Fig. 12
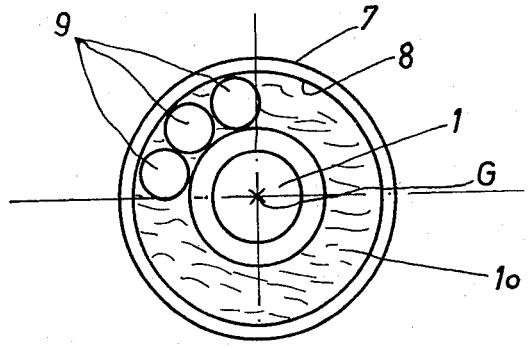
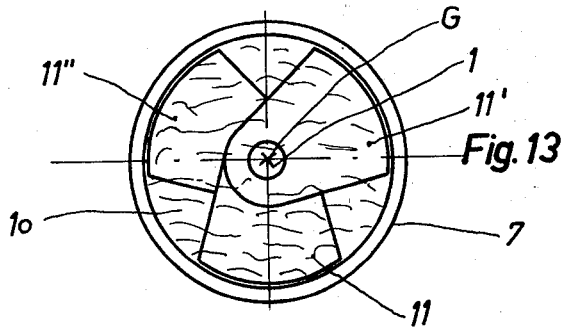
Fig. 13
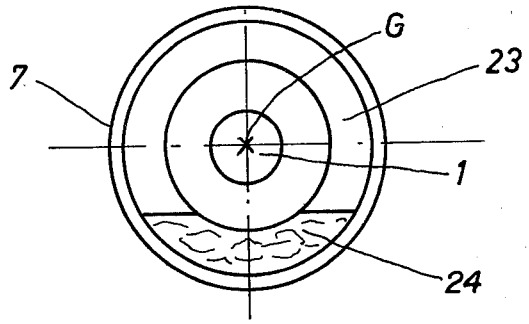
Fig. 14

APPARATUS FOR BUILDING A ROTATIONALLY SYMMETRICALLY EVENED BOBBIN PACKAGE AND METHOD OF OPERATING THE APPARATUS

BACKGROUND OF THE INVENTION

The present invention relates to a new and improved construction of apparatus for building a rotationally symmetrically evened bobbin package with a bobbin chuck for supporting the bobbin and with a friction drive drum for driving the bobbin and also pertains to a method of operating the apparatus.

The equipment and methods known thus far for building rotationally symmetrically evened bobbin packages using a friction drive drum as a drive element are based on winding devices, the bobbins of which rotate in a range of rotational speeds below the critical rotational speed or critical speed which is realized by rigidly mounting the bobbin chuck support bearings and by using bobbin chucks of correspondingly massive design.

The critical speed or critical rotational speed, as such terms are used herein, is understood to mean the rotational speed of a shaft at which some periodic disturbing force coincides with the fundamental or some higher mode of the natural frequency or torsional or transverse vibration of the shaft and its attached masses.

Massive bobbin chucks, or bobbin chucks of large diameter, respectively, however possess the disadvantages that they require the use of bobbin tubes of large diameters, which not only are heavier and more expensive but also take-up less yarn package weight at a given outside diameter of the completed bobbin package and furthermore, the large bearing diameters required by the large bobbin tube diameters cause frequent difficulties at high rotational speeds, not even considering the high price of such large bearings.

A further disadvantage of an operational range of rotational speeds below the critical rotational speed resides in the fact that, while taking into account a maximum bobbin tube diameter as determined by economic considerations, the maximum winding speed is likewise limited, and hence the production capacity is also limited. Furthermore, the bobbin package weight obtainable at speeds below the critical rotational speed must be correspondingly limited which also is considered disadvantageous.

As increased production rates are required it is the objective to increase the winding speeds to 3,000 meters per minute and higher, which, if economically feasible bobbin tube diameters and bobbin weights are to be used, requires that the bobbin chucks rotate at speeds above the critical rotational speeds.

High rotational speeds of the bobbin chucks, however, also require improved concentricity of the rotational movement of the friction drive drums which also rotate at higher speeds in order that detrimental influences are kept to a minimum upon the rotationally symmetrically even bobbin package build.

Practical experience, however, has shown that when using a bobbin chuck operated at speeds above the critical rotational speed, it is not possible to obtain a satisfactory bobbin package build or formation without additional measures or precautions, since the conditions of movement are such that a one-sided deformation of the bobbin is favored.

SUMMARY OF THE INVENTION

It thus is a primary object of the present invention to eliminate these detrimental influences in such manner that the advantages of the range of speeds above the critical rotational speed can be fully utilized, i.e. that also during operation at speeds above the critical rotational speeds a rotational symmetrically even bobbin package build is achieved.

According to the invention this objective is achieved by means of an apparatus for building a rotationally symmetrically evened bobbin package with a bobbin chuck for supporting the bobbin and with a friction drive drum for driving the bobbin, which is characterized by the features that the bobbin chuck is rotatable at speeds above the critical rotational speed and that on the bobbin chuck a balancing element is provided with a mass freely movable on a circular path substantially concentric with the bobbin chuck axis, which mass in the centered position of the bobbin chuck is distributable evenly and automatically along the path.

The method of operating the apparatus for building a rotationally symmetrically evened bobbin package driven by a friction drive drum and mounted on a bobbin chuck is characterized by the features that the bobbin is rotated at a speed which for the bobbin chuck rotating about a given rotational axis is above the critical rotational speed, and furthermore, if deviations of the bobbin chuck axis occur, caused by a one-sided bobbin package build and by an imbalance generated thereby and/or generated by an existing imbalance and a one-sided bobbin package build resulting therefrom, a mass circulating freely and concentrically about the bobbin chuck axis comes to rest at the maximum distance from the above-mentioned rotational axis until a side of the bobbin package which is less compacted due to the one-sided bobbin package build is again evenly compacted owing to the balancing action generated by the mass and the increasing contacting pressure between the bobbin chuck and the friction drive drum consequently generated on this side, and that the bobbin chuck axis thus again reaches its original position.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIGS. 7 and 8 are each schematic cross-sectional views of a bobbin chuck with a balancing mass and with a friction drive drum as viewed in the direction of the arrow IV of FIG. 6 as well as in section along the line Y — Y thereof;

FIGS. 9 to 11 are each schematic views of exemplary embodiments of bobbin chucks with a balancing mass; and FIGS. 12 to 14 are each schematic views of exemplary embodiments of balancing masses.

DETAILED DESCRIPTION OF THE INVENTION

Figure 1:
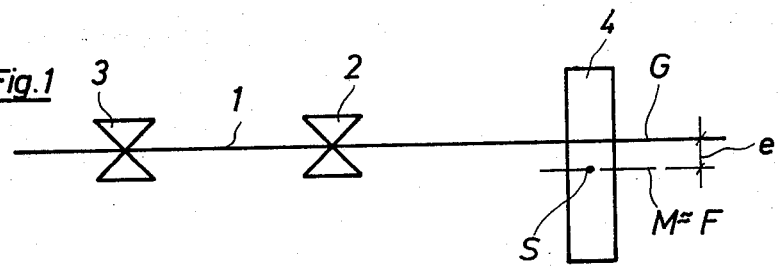
FIG. 1 is a schematic side view of an overhanging or cantilevered bobbin chuck at standstill.

Referring now to the drawings, a bobbin chuck 1 (FIGS. 1 through 3 and 6) of a winding device (not shown) is rotatably supported by a respective bearing 2 and 3 in a so-called overhanging or cantilevered arrangement. A bobbin 4 is placed on the bobbin chuck 1. An axis M through the center of gravity S of the mass of the bobbin 4 is located at a distance $e$ from the geometrical central axis G of the bobbin chuck. In FIG. 1 the bobbin chuck 1 and the bobbin or bobbin package 4 are shown at standstill. The axis M approximately coincides with the free axis F about which the body substantially consisting of the bobbin chuck 1 and of the bobbin 4 would rotate in the absence of external forces.

Figure 2:
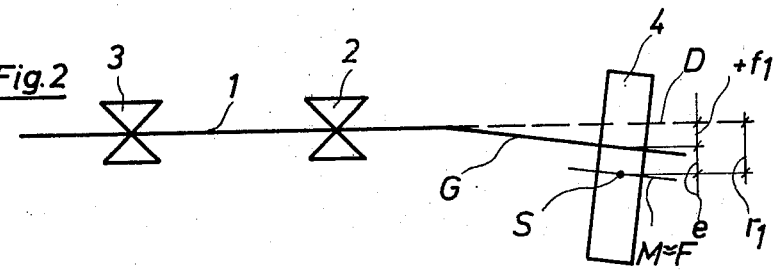
FIG. 2 is a schematic side view of the bobbin chuck according to FIG. 1 rotating at a speed below the critical rotational speed.

Now if the bobbin 4 is rotated then it rotates until the critical rotational speed or critical speed is reached in the manner indicated in FIG. 2 with considerable exaggeration and as is well-known in the art of kinematics, and mechanics, i.e. the center of gravity S girates at a radius $r_1$ about the rotational axis D. The axis D in this arrangement corresponds to the axis about which the body rotates. The radius $r_1$ is determined by the sum of the distance $e$ and the distance $f_1$ given by the deviation of the geometric axis G from the rotational axis D, the relation being expressed as:

$$r_1 = e + f_1$$

The center of gravity S tends to move away from the rotational axis D, i.e. $f_1$ increases.

Figure 3:
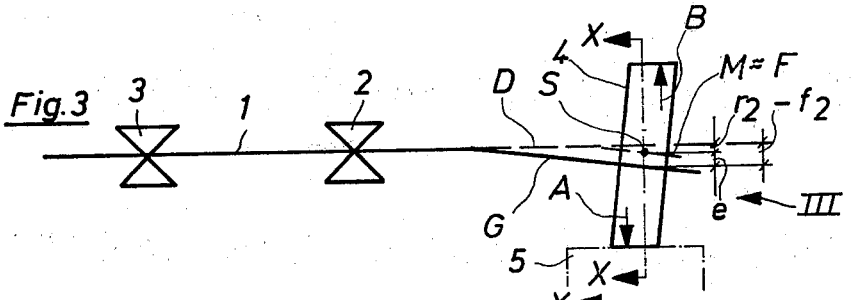
FIG. 3 is a schematic side view of the bobbin chuck according to FIG. 1 rotating at a speed above the critical rotational speed, the friction drive drum being schematically shown.
Figure 6:
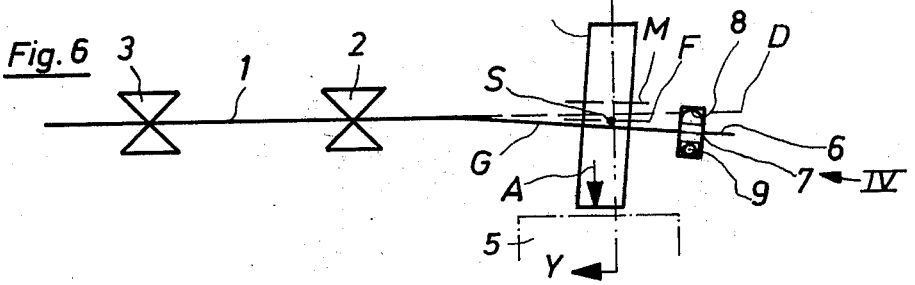
FIG. 6 is a schematic side view of an overhanging or cantilevered bobbin chuck with a balancing mass.

In the speed range above the critical rotational speed, as is well known and as also indicated in FIG. 3 with considerable exaggeration, the bobbin 4 rotates in such manner that the center of gravity S again tends to move towards the rotational axis D, so that the radius $r_2$, at which the center of gravity S girates about the rotational axis D, strives towards the value null. The distance $f_2$ resulting from the deviation of the geometric axis G from the rotational axis D thus becomes negative in relation to the distance $e$, the relation being expressed as:

$$r_2 = e - f_2 \qquad r_2 \Rightarrow 0 \quad f_2 \Rightarrow e$$

Notwithstanding the fact that the center of gravity S is centered during rotation in the speed range above the critical rotational speed the deviation of the geometric axis G from the rotational axis D persists if no further precautions are taken.

Figure 4:
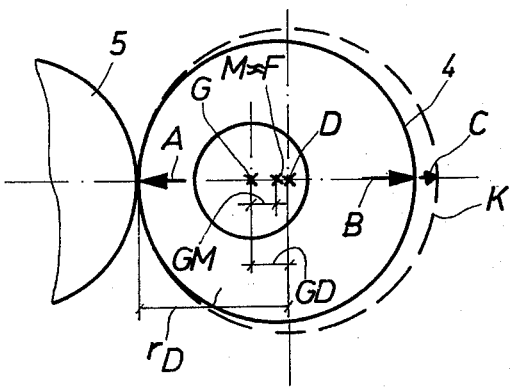
FIGS. 4 and 5 are each schematic cross-sectional views of a bobbin chuck with a bobbin package and a friction drive drum viewed in the direction of the arrow III of FIG. 3 and in section along the line X — X thereof.
Figure 5:
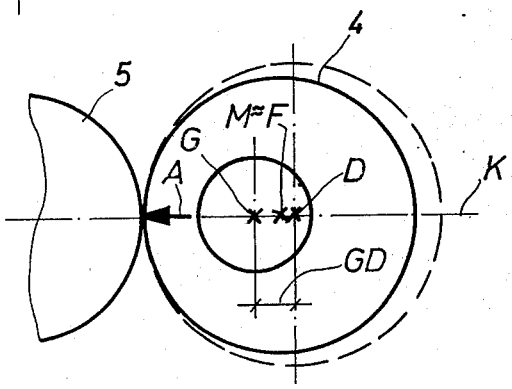

If there is used a friction drive drum 5 (shown in FIGS. 3 and 6 with dash-dotted or phantom lines and with solid lines in FIGS. 4, 5, 7 and 8) for driving the bobbin 4, the resulting deviation causes the formation of a more compacted bobbin package side A between the bobbin chuck 1 and the rigidly supported friction drive drum 5 (FIGS. 3, 4 and 5). In the extreme case, caused by the compacting of the bobbin package side A, the opposite bobbin package side B (FIGS. 3 and 4) contacts the friction drive drum 5 barely or not at all, as indicated with considerable exaggeration in FIG. 4 by the distance C. The distance C corresponds to the distance between the bobbin package surface at the bobbin package side B and an imaginary circle K, the radius $r_D$ of which is given by the distance between the friction drive drum 5 and the rotational axis D. Furthermore, due to the one-sided compacting, the distance $\overline{GD}$ according to FIG. 4 increases as the bobbin package becomes larger, reaching e.g. a larger value illustrated in FIG. 5 and therefore the unbalance of the bobbin package increases.

For eliminating such one-sided compacting of the bobbin package 4, or, respectively, for again levelling-out or compensating the occurring deviations, a balancing means or element 7 is provided on the bobbin chuck 1, e.g. at its free end 6, with a circular race 8 on which a mass, consisting of a plurality, e.g. of three, individual balls 9 (one only being visible in FIG. 6) is arranged to be freely movable.

Figure 7:
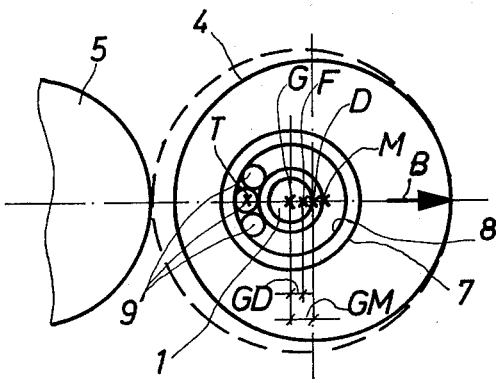

If an unbalance is generated in the bobbin package for any reason and therefore a deviation of the bobbin chuck 1 or the geometrical axis G respectively, as previously described, then the three balls 9 (FIG. 7), under the influence of the centrifugal force, move into the zone where the distance from the rotational axis D is greatest. Consequently, the free axis F which thus far approximately coincided with the gravitational axis M of the bobbin 4 moves away from the gravitational axis M into a new position between the axis M and the common center of gravity T (FIGS. 6 and 7) of the three balls, so that the axis M is located on the side of the rotational axis D opposite the free axis, provided the mass of the three balls is sufficiently large. Owing to this shift of the axis M to the opposite side — as seen in relation with the rotational axis D — of the initial position, the geometric axis G and thus the bobbin chuck 1 thus is again shifted into closer vicinity to the rotational axis D in such a manner that the distance $\overline{GD}$, as illustrated in FIG. 7, becomes smaller than the distance $\overline{GM}$ ($\overline{GD}<\overline{GM}$) in contrast to the bobbin chuck heretofore described with reference to FIG. 4 without a balancing element and in which arrangement the distance $\overline{GD}$ becomes larger than $\overline{GM}$ ($\overline{GD}>\overline{GM}$).

Approaching the geometric axis G to the rotational axis D, in other words, the desired centering of the bobbin chuck 1 causes the more compacted bobbin package side A to move away from the friction drive drum 5 (FIG. 6) and the less compacted bobbin package side B (FIG. 7) to move closer to the friction drive drum 5. This shift is effected until the bobbin chuck 1 is again centered, until the balls are again evenly distributed and until the bobbin package substantially again shows a cylindrically symmetrically build or formation as shown in FIG. 8.

For accelerating the balls sufficiently rapidly to the rotational speed of the chuck and for permitting only dampened oscillation of the balls, the balls 9 are e.g. enclosed in a liquid-filled chamber 10 (FIGS. 12 and 13).

Instead of using for instance three balls 9 — a minimum of at least two balls are necessary — other easily movable rigid masses, for example three pendulum members 11, 11′ and 11″ (FIG. 13), each equipped with a pivoting axis on the geometrical axis G can be used.

If two rigid masses are selected then exactly identical masses and exactly identical radial distances of the individual centers of gravity from the axis G are required, which as a practical matter requires extremely precise manufacturing tolerances. It is for this reason that as a general rule more than two masses are chosen, so that differences of the individual masses and the abovementioned distances from the axis G during the centered running of the bobbin chuck can be again balanced due to the automatically regulating different distances from mass to mass.

A further embodiment of the balancing element 7 is shown in FIG. 14 in which a liquid 24 is used as the mass, this liquid only partially filling a chamber or compartment 23 arranged concentrically with respect to the bobbin chuck 1.

In FIG. 9, wherein the same elements have been designated with the same reference characters, there is shown a further design example according to the invention in which a further balancing element 12 is provided between the bearing 2 closer to the bobbin 4 and the bobbin 4 on the bobbin chuck 1.

The construction according to this embodiment is particularly suitable in situations as shown in FIG. 10 wherein the bearings 2 and 3 respectively are elastically or resiliently supported with respect to a machine frame 13 by means of spring elements 14 and 14' respectively.

A further exemplary embodiment is shown in FIG. 11 in which a bobbin chuck 15 supporting the bobbin 4 is rotatably supported at both sides by a bearing 16 and 17 respectively. The bearings 16 and 17 are each elastically supported by the machine frame 20 via a spring element 18 and 19 respectively. At both sides of the bobbin package a balancing element 21 and 22 respectively is connected with the bobbin chuck 15 for achieving the functions described above for an or cantilevered type bobbin chuck.

The inventive apparatus is not limited to the production of cylindrical bobbin packages; also bobbin packages of conical or other formation or build can be produced.

Some of the more notable advantages of the invention are the following:

a. prevention of unbalances during the build or formation of the bobbin;

b. achievement of a rotationally symmetrical bobbin package build; and c. compensation of existing residual unbalances of bobbin tubes and rotating machine parts.

While there is shown and described present preferred embodiments of the invention, it is to be distinctly understood that the invention is not limited thereto but may be otherwise variously embodied and practiced with the scope of the following claims.

What is claimed is:

1. An apparatus for building a substantially rotationally symmetrically evened bobbin package with a bobbin chuck having a bobbin chuck axis and serving for supporting the bobbin and with a friction drive drum for driving the bobbin about an axis of rotation, the improvement comprising: said bobbin chuck being rotatable at speeds above a critical rotational speed, said bobbin chuck assuming a centered position when said bobbin chuck axis and said bobbin axis of rotation essentially coincide, a balancing element provided on the bobbin chuck, said balancing element serving for enabling the correction of incipient unbalances of the bobbin package which shifts the bobbin chuck axis away from the bobbin axis of rotation and out of the centered position of the bobbin chuck, said balancing element being equipped with a mass which is freely movable along a substantially circular path which is substantially concentric with the bobbin chuck axis, said mass in the centered position of the bobbin chuck being evenly and automatically distributable along said path, said mass acting upon the bobbin chuck upon the occurrence of incipient unbalances at the bobbin package, in order to move the bobbin chuck axis towards the bobbin axis of rotation, said friction drive drum then further winding the bobbin package to eliminate such unbalance by bringing the bobbin chuck axis and bobbin axis of rotation essentially into coincidence.

2. The apparatus as defined in claim 1, wherein said mass comprises at least two substantially identical balls of the same diameter.

3. The apparatus as defined in claim 1, wherein said mass comprises at least three balls.

4. The apparatus as defined in claim 1, wherein said mass comprises two substantially similar pendulum elements which pivot about the bobbin chuck axis, said pendulum elements possessing radial distances from the center of gravity of the bobbin chuck which are essentially the same.

5. The apparatus as defined in claim 1, wherein said mass comprises at least three pendulum elements mounted for pivotable movement about the bobbin chuck axis.

6. The apparatus as defined in claim 1, wherein said balancing element comprises a rigid substantially cylindrical chamber arranged substantially concentrically with respect to the bobbin chuck, said chamber being partially filled with a liquid serving as the balancing mass.

7. The apparatus as defined in claim 2, wherein a liquid is enclosed in the balancing element for damping movements of the balls.

8. The apparatus as defined in claim 4, wherein a liquid is enclosed in the balancing element for damping movements of the pendulum elements.

9. The apparatus as defined in claim 1, wherein said balancing element is arranged in a plane which is disposed substantially at right angles with respect to the bobbin chuck axis.

10. The apparatus as defined in claim 1, further including an additional balancing element, said two balancing elements each being arranged in a separate plane.

11. The apparatus as defined in claim 1, further including means for supporting the bobbin chuck at one side in cantilevered arrangement.

12. The apparatus as defined in claim 11, wherein said supporting means elastically supports the bobbin chuck at one side in a cantilevered arrangement.

13. The apparatus as defined in claim 1, further including means for supporting the bobbin chuck at both sides of the bobbin.

14. The apparatus as defined in claim 13, wherein said supporting means elastically supports the bobbin chuck at both sides of the bobbin.

15. A method of building a rotationally symmetrically evened bobbin package with a bobbin chuck for supporting the bobbin and with a friction drive drum for driving the bobbin, comprising the steps of: rotating the bobbin at a speed which, for the bobbin chuck rotating about a given rotational axis, is above a critical rotational speed, and upon the occurrence of deviations of the bobbin chuck axis from the bobbin rotational axis caused by one-sided formation of the bobbin package and by an unbalance generated thereby or caused by an existing unbalance and a one-sided bobbin package formation resulting therefrom bringing a mass which circulates freely and concentrically about the bobbin chuck axis to rest at a maximum distance from the bobbin rotational axis governed by the deviation of the bobbin chuck axis from the bobbin rotational axis until a side of the bobbin package build is again evenly compacted owing to the balancing action generated by the mass and to the increasing pressure between the bobbin chuck and the friction drive drum generated at such side and until the bobbin chuck axis has thus again reached its original position.

16. The method as defined in claim 15, including the step of damping the circular movement of the mass relative to the bobbin chuck.

17. The apparatus as defined in claim 1, wherein the mass of the balancing element is not greater in size than needed to enable correction of the incipient unbalances which may arise.

* * * * *